US005170709A

United States Patent [19]

Jackson et al.

[11] Patent Number: 5,170,709

[45] Date of Patent: * Dec. 15, 1992

[54] INKING DEVICE FOR POSTAGE METERS

[75] Inventors: Jerome E. Jackson, Newtown; Charles F. Murphy, III, Fairfield, both of Conn.

[73] Assignee: Pitney Bowes Inc., Stamford, Conn.

[ * ] Notice: The portion of the term of this patent subsequent to Oct. 15, 2008 has been disclaimed.

[21] Appl. No.: 776,012

[22] Filed: Oct. 15, 1991

[51] Int. Cl.[5] ..... B41K 1/54; B41L 27/26; B41F 31/24

[52] U.S. Cl. ..... 101/335; 101/333; 118/264; 118/270

[58] Field of Search ..... 101/335-343, 101/333, 104, 105, 108; 118/264, 265, 270; 156/442, DIG. 50; 222/187, 424; 401/206, 15

[56] References Cited

U.S. PATENT DOCUMENTS

| | | | |
|---|---|---|---|
| 1,782,505 | 11/1930 | Harris | 118/270 |
| 2,152,682 | 4/1939 | Dwofsky | 118/265 |
| 2,399,400 | 4/1946 | Snelling | 118/270 |
| 2,658,474 | 11/1953 | Sengbusch | 118/270 |
| 4,419,931 | 12/1983 | Siegal | 101/333 |
| 4,699,054 | 10/1987 | Scrudato et al. | 101/335 |
| 4,945,831 | 8/1990 | Buan et al. | 101/340 |

FOREIGN PATENT DOCUMENTS

| | | | |
|---|---|---|---|
| 0027491 | 6/1884 | Fed. Rep. of Germany | 118/270 |
| 3129462 | 2/1983 | Fed. Rep. of Germany | 118/270 |

*Primary Examiner*—Edgar S. Burr
*Assistant Examiner*—Lynn Hendrickson
*Attorney, Agent, or Firm*—Charles G. Parks, Jr.; Melvin J. Scholnick

[57] ABSTRACT

An inking device for postage meter in a high speed mailing machine is disclosed, the inking device functioning to apply ink to a printing die in the postage meter between each printing operation performed by the postage meter. The inking device includes an ink pad disposed in a reservoir and held therein by a cover member having an aperture through which an upper portion of the ink pad projects so as to contact the lower printing surface of the printing die. The configuration of the ink pad is such that there is a small channel or space between the outer edges of the ink pad and the inner edges of the aperture of the cover member so that ink which is squeeze out of the ink pad during compression thereof with the printing die will not ooze onto the upper surface of the cover member and eventually spread onto other parts of the mailing machine.

4 Claims, 5 Drawing Sheets

INKING DEVICE FOR POSTAGE METERS

BACKGROUND OF THE INVENTION

The present invention relates generally to a high speed mailing machine which includes a postage meter for applying a postage indicia to mail pieces passing through the machine. More particularly, the present invention relates to an improved inking device in the postage meter for continuously applying ink to the printing die of the meter.

In a typical high speed mailing machine, mail pieces usually in the form of envelopes, are fed seriatim along a feed deck by suitable feeding devices past a plurality of working stations which usually include an envelope flap opening device, a flap moistening device, a flap closing and sealing device, a postage meter, and a stacking device. The mailing machine may also include a scale for weighing the mail pieces before they pass through the postage meter. A principal advantage of such machines is that they can perform the aforementioned operations on mail pieces at a very high rate of speed, typically about three to four mail pieces per second, and therefore are very attractive to high volume mailers such as credit institutions, telephone companies, telemarketing operations, etc.

One of the limiting factors in maintaining high speed operation of such mailing machines is the speed with which the printing die of the postage meter can be reinked after each cycle of operation. Reinking after each printing cycle is necessary in order to consistently print a sharp, uniform indicia on each envelope which will pass the rigid print quality standards of the U.S. Postal Service. Thus, during each printing cycle, the printing die of the postage meter is inked by an inking device which normally is disposed in a home position, and which s extended laterally to an operative position. In this position, the inking device is moved upwardly to press against the underside of the printing die which applies the postage indicia to the envelopes as they are fed through the postage meter. Immediately after being pressed against the printing die, the inking device is lowered and retracted to its home position, after which the printing operation takes place. Thus, during each cycle of operation, the inking device moves from a home position laterally of the direction of envelope movement to the operative position, then upwardly to ink the printing die, then downwardly, and finally laterally back to the home position.

When it is considered that the mailing machine with which the present invention is concerned is capable of handling as many as four mail pieces per second, it becomes apparent that the foregoing cycle of operation of the inking device occurs at a very high rate of speed, with successive movements of the inking device being measured in milliseconds. A typical cycle of operation requires about 100 ms, of which only 40 ms are required for movement of the inking device, the other 60 ms occurring while the inking device is stationary. Thus, the movement of the inking device during each cycle of operation is characterized by extremely rapid acceleration and deceleration between successive increments of movement, as a result of which large acceleration and deceleration forces are imposed on the individual parts of the inking device. In fact, each acceleration and deceleration produces about three to four Gs of force on these parts, and even though the individual parts are of relatively small mass, the effect of these forces creates problems which are unacceptable from the standpoint of maintaining a functional postage indicia printing device.

It has been found through high speed photography that each time the inking device is accelerated and decelerated in the direction of lateral movement, the aforementioned forces are sufficient to laterally distort the ink pad along the front and rear edges thereof, which normally are in virtual contact with the adjacent inner edges of the walls of an ink reservoir in which the ink pad is disposed. When the ink pad is moved upwardly and pressed against the printing die, the ink pad is compressed, and the edges thereof are bulged upwardly and outwardly, with the result that the ink in the bulged edges of the pad is squeezed out onto the adjacent upper surface of a cover which secures the ink pad in an ink holding tray. If this were the sole movement of the ink pad, the ink which is squeezed out onto the adjacent upper surface of the cover would immediately be reabsorbed by the ink pad, although this could require about four to five seconds to occur. However, the rapid acceleration and deceleration of the inking device at the rate of four cycles per second does not leave sufficient time for the edges of the ink pad to reabsorb the ink squeezed onto the cover before the forces created by the rapid acceleration and deceleration cause the edge portions of the ink pad to distort in and outward direction, depending on whether the front or rear edge of the ink pad is being considered. This distortion tends to push the ink on the cover further away from the ink pad and thereby even further inhibit any reabsorption of the ink on the cover by the ink pad.

One solution to this problem would be to use an ink pad formed of a relatively stiff material which would not distort upon acceleration and deceleration, or bulge in response to compression from contact with the printing die. However, it is necessary to use a relatively flexible material so that the ink pad will conform as precisely as possible to the planarity of the surface of the printing die to assure an even application of the ink to the entire surface of the die in order to obtain the best possible print quality for the indicia. Although the amount of ink which is squeezed onto the lid during each cycle of operation is relatively small, after several tens of thousands of such cycles, sufficient ink is deposited on the lid to cause it to slosh onto other parts of the inking device and eventually to be deposited on envelopes as they are fed through the postage meter, thereby resulting either in partially illegible indicia or peripheral ink smudges elsewhere on the envelopes, or both, either of which is completely unacceptable. Thus, while the technical nature of the problem may seem relatively small, the operating requirements of the machine in which the problem occurs is such that the machine is not a commercially viable product so long as the problem exits.

SUMMARY OF THE INVENTION

The present invention is intended to obviate if not completely eliminate the problem discussed above to the extent that the mailing machine is acceptable as a commercially viable product.

The present invention solves the aforementioned problem by providing a small channel or space between the outer edges of an upper portion of the ink pad and the adjacent inner edges of the lid which secures the ink pad in the ink tray. The channel is provided along at least the front and rear edges of the ink pad and preferably along all four edges. The function of the channel, as will be seen in more detail herein below, is to provide a space between the adjacent outer edges of the ink pad and the inner edges of the cover for collecting ink which is squeezed from the edge portions of the ink pad when it is pressed against the printing die of the postage meter, and which would otherwise be deposited on the adjacent upper surface of the cover member. When the ink pad is moved away from the printing die, the ink which has collected in the aforementioned space is immediately reabsorbed back into the ink pad and is available for transfer to the printing die on the next cycle of operation. The ink collection channel need be only wide enough to accept the relatively minuscule amount of ink which is squeezed out each time the ink pad is pressed against the printing die since the ink is reabsorbed back into the pad as soon as the pressure on the pad is relieved by moving the pad away from the printing die.

Thus, the present invention, in its broader aspects, comprises an inking device for continuously applying ink to the printing die of a postage meter during operation of the postage meter, and comprises an ink reservoir having a generally rectangular tray with a relatively flat bottom wall and relatively short upstanding peripheral side walls. An ink pad is disposed in the reservoir and is formed of a relatively flexible, porous absorbent material adapted to hold ink. The ink pad has a main body portion having peripheral dimensions such that the main body portion fits within the peripheral walls of the tray and covers at least a major portion of the area of the bottom walls. The ink pad also has a raised central portion having an upper surface adapted to contact and apply ink to the printing die of the postage meter, this raised central portion having peripheral dimensions less than the peripheral dimensions of the main body portion thereby defining a peripheral flange extending around the raised central portion. A generally rectangular flat cover member is provided for securing the ink pad in the tray, the cover member having peripheral walls adapted to overlie the peripheral flange of the ink pad, the peripheral walls of the cover member defining an aperture through which the raised central portion of the ink pad projects to expose the upper surface of the central portion. Finally, at least two opposed inner edges of the cover member are spaced farther apart than the corresponding outer edges of the raised central portion of the ink pad thereby defining a small channel disposed between the inner edges of the cover member and the outer edges of the raised central portion of the ink pad. Thus, any ink which oozes into the distorted edge portions of the ink pad when the latter is distorted upon contact of the ink pad with the printing die of the postage meter is collected in the aforementioned channel and is reabsorbed by the ink pad.

Having briefly described the general nature of the present invention, it is a principal object thereof to provide an improved inking device for postage meters which avoids the problem of ink smearing on the inking device parts and transferring to envelopes passing through the postage meters.

It is another object of the present invention to provide an improved inking device for postage meters which prevents ink from being deposited on the inking device parts when the ink pad is pressed against the printing die of the postage meter.

It is still another object of the present invention to provide an improved inking device for postage meters in which ink which is squeezed from edge portions of the ink pad during transfer of ink to the printing die of the meter is momentarily stored in a channel and reabsorbed back into the ink pad when the pad is moved away from the printing die.

These and other objects and advantages of the present invention will become more apparent from an understanding of the following detailed description of a presently preferred embodiment of the present invention when considered in conjunction with the accompanying drawings.

DETAILED DESCRIPTION OF THE INVENTION

Figure 1:
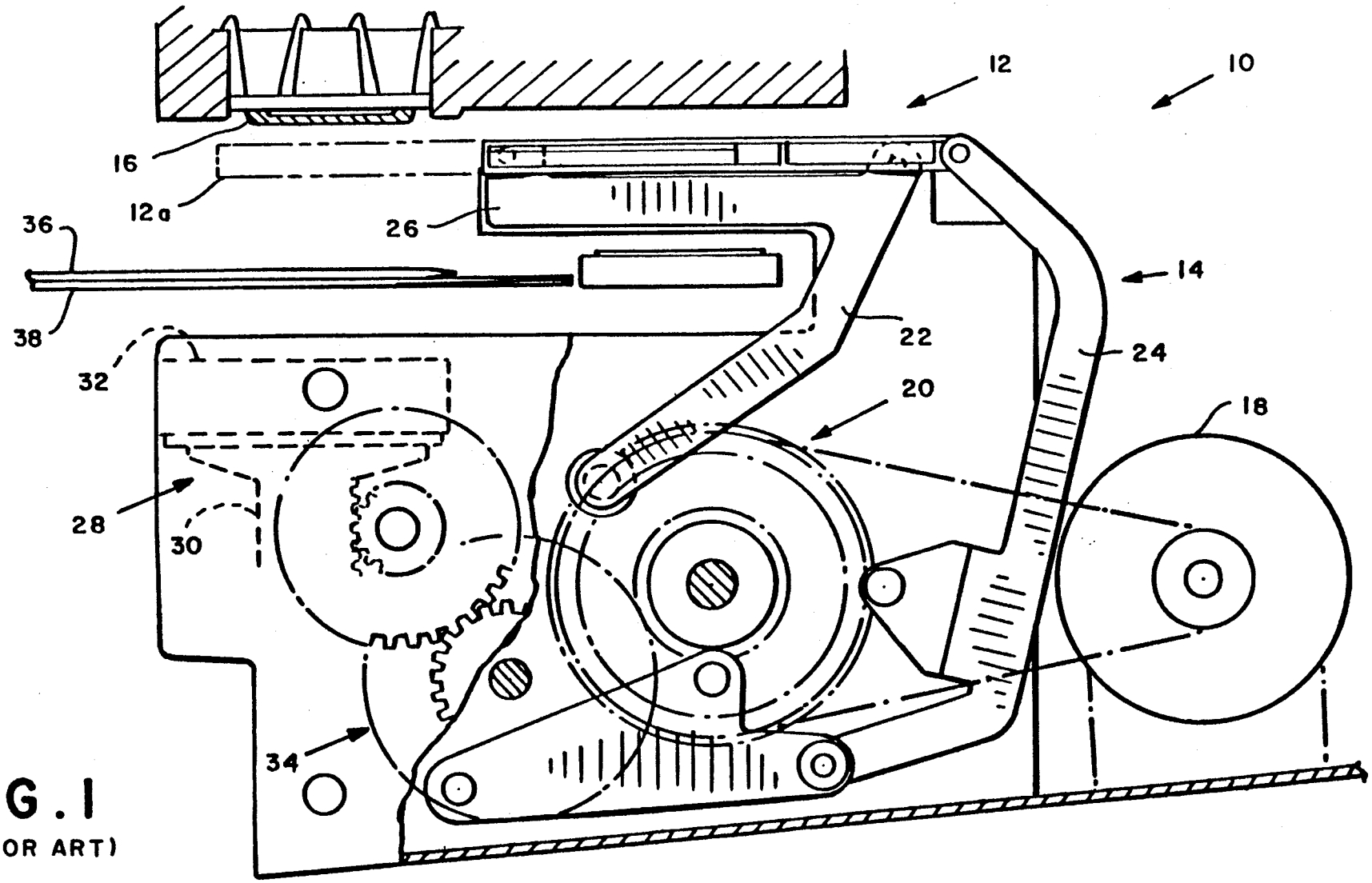
FIG. 1 (PRIOR ART)
FIG. 1 is fragmentary view of the portion of a postage meter which controls the movement of the inking device from a home position to an operative position during each cycle of operation of the postage meter.

Referring now to the drawings, and particularly to FIG. 1 thereof, the reference numeral 10 indicates generally an apparatus for moving the inking device of a postage meter from a home position to an operative position and back during each printing cycle of the postage meter, the apparatus being shown in a somewhat fragmentary manner since it is not an essential part of the present invention. A full and complete disclosure of this apparatus will be found in U.S. Pat. No. 4,945,831, issued Aug. 7, 1990 and assigned to the assignee of this application.

For the purpose of describing the present invention, it is necessary to note only that an inking device, generally designated by the reference numeral 12, is carried by a transport mechanism generally designated 14 to move the inking device 12 from a home position shown in solid lines in FIG. 1 to an operative position represented by the dotted lines 12*a* in which the inking device 12 directly underlies a printing die 16 of the postage meter.

The transport mechanism 14 comprises a motor 18 which drives a cam assembly generally designated 20 which in turn drives a pair of levers 22 and 24 which are connected to a suitable carrier 26 for the inking device 12. The cam assembly 20 and the levers 22 and 24 are effective to move the inking device 12 from the home position to the operative position, and then to lift the inking device 12 so that it is pressed against the underside of the printing die 16 to transfer ink from the inking device to the printing die. Immediately thereafter, the inking device is lowered back to the dotted line position 12*a* and is then retracted backwardly to the home position, thereby completing a cycle of operation of the inking device.

The apparatus 10 also includes a platen device generally designated 28 which comprises a rack 30 which supports a resilient platen 32 and is driven vertically by a suitable gear arrangement generally designated 34 which is also driven by the motor 18. The operation of the platen device is synchronized with the operation of the inking device so that the platen device raises the envelope 36 off the supporting deck 38 to press it against the underside of the printing die 16 when the inking device is in its home position.

From the foregoing description, it will be apparent that the cycle of operation of the apparatus shown in FIG. 1 is that the inking device 12 is moved from the home position forwardly to the operative position shown in dotted line, and is then raised until it is pressed against the underside of the printing die 16 to transfer ink from the inking device to the printing die. The inking device is then lowered to the dotted line position and moved rearwardly to the home position, thereby completing its cycle of operation. Between each cycle of operation of the inking device, the envelope 36 is moved upwardly by the platen device 28 to press the envelope against the underside of the printing die 16 to transfer an image of the indicia on the printing die to the envelope, after which the platen device 28 lowers the envelope back to the feed deck 38 for transfer away from the postage meter.

Figure 2:
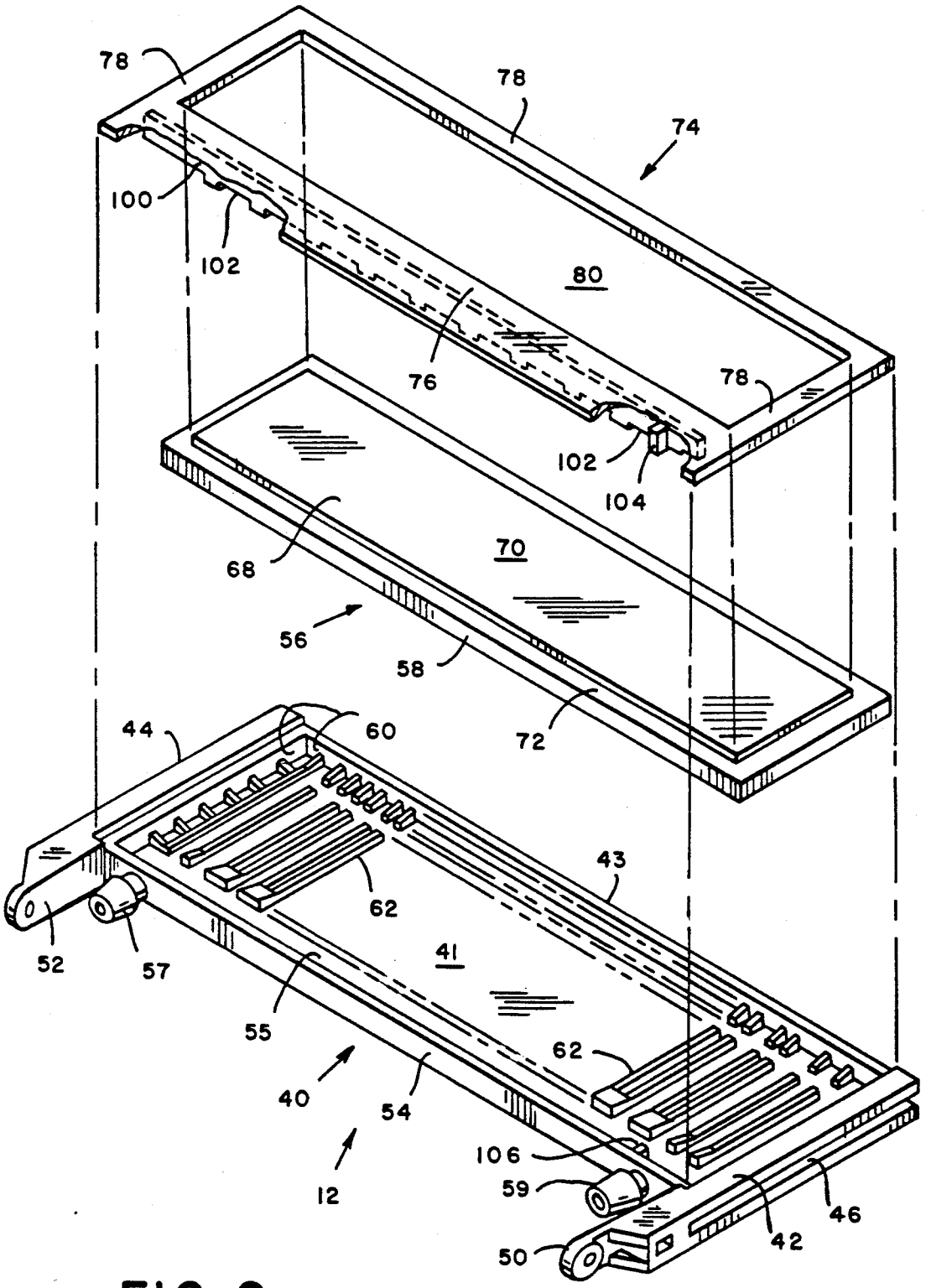
FIG. 2 is an exploded view of the major parts of the inking device of the apparatus shown in FIG. 1.

Referring now to FIG. 2, the inking device 12 is seen to comprise a generally rectangular tray 40 having a bottom wall 41, a front wall 43 and a pair of side frame members 42 and 44 which define upstanding side walls and which have grooves 46 and extensions 50 and 52 which together form the means by which the tray 40 is mounted on the carrier 26. An upstanding rear wall 54 of the tray 40 is provided with a pair of hollow protrusions 57 and 59 which respectively form an inlet and an outlet for ink which is continuously pumped into and out of the tray 40 by a suitable pumping mechanism so that a constant supply of ink is maintained in the tray at all times. The manner in which the tray 40 is mounted on the carrier 26 and the details of the ink pumping mechanism are fully disclosed in the aforementioned U. S. patent and are not further disclosed herein since they are not part of the present invention.

A rectangular ink pad generally designated by the numeral 56 is formed of a relatively flexible, porous absorbent foam material and has a main body portion 58 which has peripheral dimensions such that it fits within the inner edges 60 of the side and front walls of the tray 40. The ink pad does not extend to the inner edge of the front wall 43 so as to leave an elongate channel 55 extending from the ink inlet formed by hollow protrusion 57 to the outlet formed by hollow protrusion 59 through which the ink normally flows and contacts the adjacent edge of the ink pad 56 to be absorbed thereby. The tray 40 is also provided with a plurality of upstanding ribs 62 which extend laterally of the tray 40 for the purpose of supporting the ink pad 56 on the upper surfaces thereof so that ink can flow freely in the laterally extending spaces defined by the ribs 62 so as to assure that the entire ink pad is maintained properly saturated with ink.

The ink pad 56 also includes a raised central portion 68 which defines the inking surface 70 which contacts the printing die 16 to apply ink thereto. The raised central portion 68 has peripheral edge dimensions which are slightly less than the peripheral edge dimensions of the main body portion 58 thereby defining a peripheral flange 72 formed integrally with the main body portion 58 and extending outwardly around the raised central portion of the ink pad 56.

Figure 3:
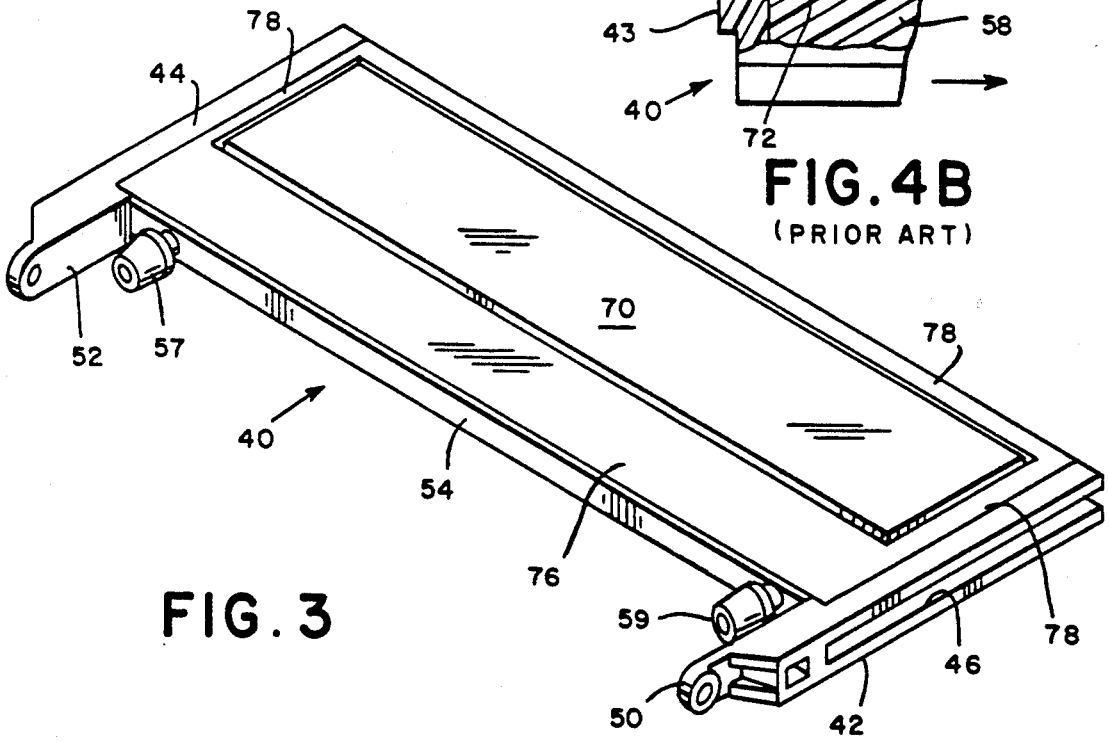
FIG. 3 is a view of the inking device parts shown in FIG. 2 in their assembled relationship.

A rectangular cover member generally designated 74 is formed as an annulus having a relatively wide back wall 76 which is adapted to cover the ink flow channel 55 as well as the adjacent portion of the peripheral flange 72 of the ink pad, and narrower side and front walls 78 which define a central aperture 80 through which the raised central portion 68 of the ink pad projects. The aforementioned peripheral walls 76 and 78 of the cover member are adapted to overlie the remaining portions of the peripheral flange 72 of the ink pad 56 in order to secure the ink pad 56 in the tray 40. The cover member is secured to the ink tray 40 by means of vibration welding after the ink pad is inserted therein. FIG. 3 shows the above described parts in their assembled position.

Figure 4A:
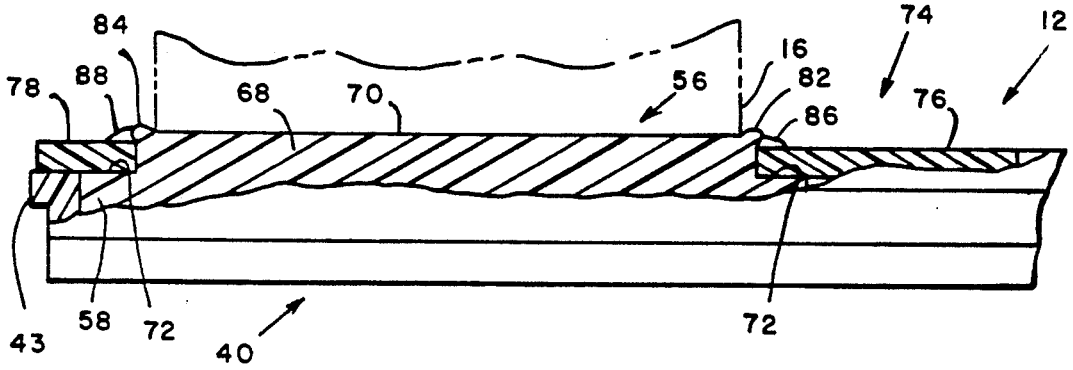
FIG. 4A (PRIOR ART)
FIG. 4A is a fragmentary sectional view of the device shown in FIG. 3 along a transverse plane, but without the feature of the present invention, and showing the configuration of the ink pad at the instant of compression of the ink pad from being pressed against the printing die to transfer ink thereto.
Figure 4B:
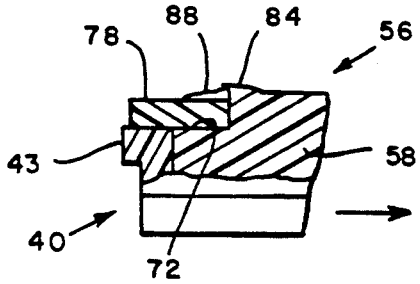
FIG. 4B (PRIOR ART)
FIG. 4B is a smaller fragmentary sectional view similar to FIG. 4A showing the configuration of the ink pad at the moment of almost instant acceleration of the inking device toward its home position.

In order to assure a complete understanding of the present invention, it will be helpful to illustrate the problem encountered when the inking device was originally designed without the present invention. Attention is directed to FIGS. 4A and 4B, which illustrate in a fragmentary manner the ink pad 56 lying in the tray 40 with the front and rear outer edges of the main body portion 58 being in virtual contact with the inner edges of the corresponding front and rear walls 78 and 76 of the cover member 74. The term "virtual contact" in this context is intended to cover not only absolute firm contact but also an extremely close proximity relationship between these edges in the order of 0.001 to 0.002 inches apart. As seen in FIG. 4A, when the inking device 12 is in its operative position and has been raised to bring the upper surface 70 of the ink pad 56 into contact with the lower surface of the printing die 16, the raised central portion 68 of the ink pad 56 is slightly compressed during contact with the printing die. This compression causes the edge portions of the ink pad just beyond the outer edges of the printing die to bulge upwardly as indicated by the numerals 82 and 84 in FIG. 4A. Since the foam material of these bulges is in a compressed state, a small amount of ink is squeezed out of the bulges 82 and 84 onto the adjacent surfaces 76 and 78, the squeezed out ink being indicated by the numerals 86 and 88. At this point, if the ink pad were merely lowered away from the printing die with no lateral movement, the small amount of squeezed out ink 86 and 88 would immediately be reabsorbed by the bulged edge portions 82 and 84 of the ink pad as these portions returned to their normal shape within the raised central portion 68 of the ink pad. Although the ink pad begins to return to its normal shape as soon as it moves out of contact with the printing die, it has been found that the reabsorption of the ink would take approximately four to five seconds after the ink pad has moved out of contact with the printing die.

It must be remembered, however, from the previous description of a cycle of operation of the mailing machine, that within a matter of mere milliseconds from the time that the ink pad moves out of contact with the printing die, there is lateral movement of the inking device 12 from the operative position to the home position, at which time the squeezed out ink 86 and 88 still remains on the cover walls 76 and 78, and the bulges 82 and 84 have not had time to return to their normal configuration within the ink pad. Thus, as shown in FIG. 4B, when the inking device suddenly accelerates in a rearward direction, the bulged portion 84 distorts in the opposite direction and tends to effect a flicking or pushing action on the ink resting on the surface of the wall 78 of the cover member. This in turn tends to push the ink 88 a little further away from the ink pad. The same action occurs at the other edge of the ink pad when it decelerates at the home position, such that the edge 82 of the ink pad pushes the ink 86 a little further away from the ink pad. Thus, with each cycle of operation of the mailing machine, a very minute quantity of ink is deposited on the cover member walls 76 and 78 and is not only not reabsorbed but rather is pushed away from the ink pad to make room for the next deposition of ink. After many tens of thousands of cycles of operation, the amount of ink which collects on the upper surfaces of the cover member becomes quite substantial. Eventually, sufficient ink is deposited on the upper surfaces of the front and rear walls of the cover member that it begins to drip off the edge and collect on other parts of the inking device, from which it is eventually transferred to envelopes passing through the postage meter, with the accompanying adverse effects explained above.

Figure 5:
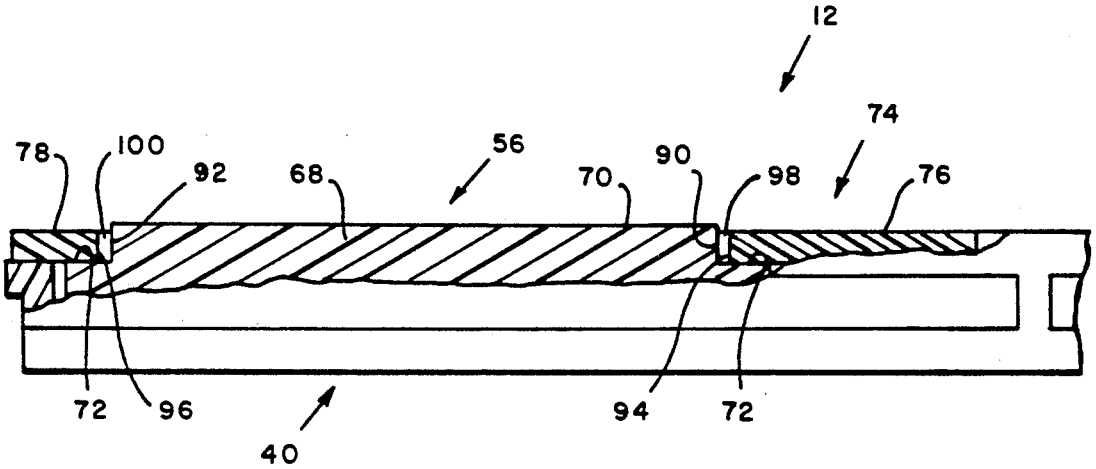
FIG. 5 is a view similar to FIG. 4 including the feature of the present invention and showing the configuration of the ink pad when it is in the home position.
Figure 7:
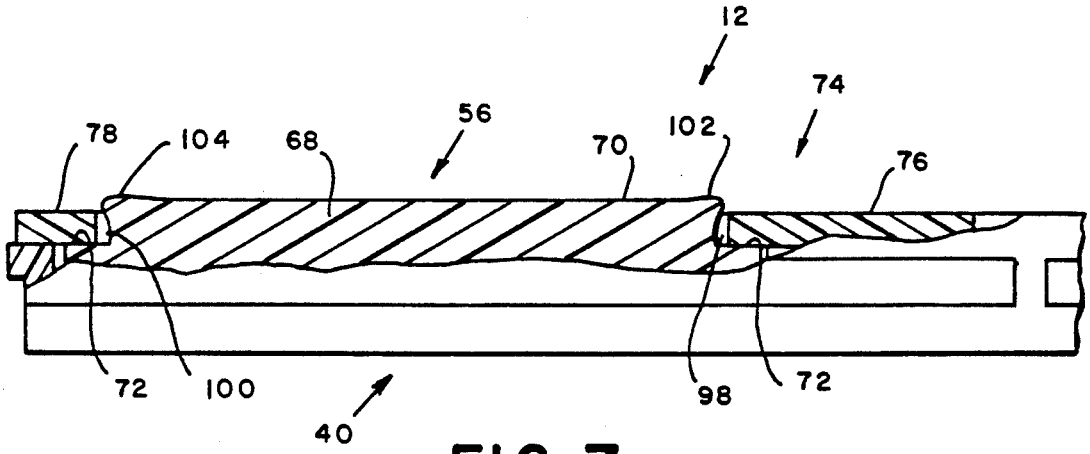
FIG. 7 is a view similar to FIG. 5 showing the configuration of the ink pad when it is pressed against the printing die of the postage meter.
Figure 6:
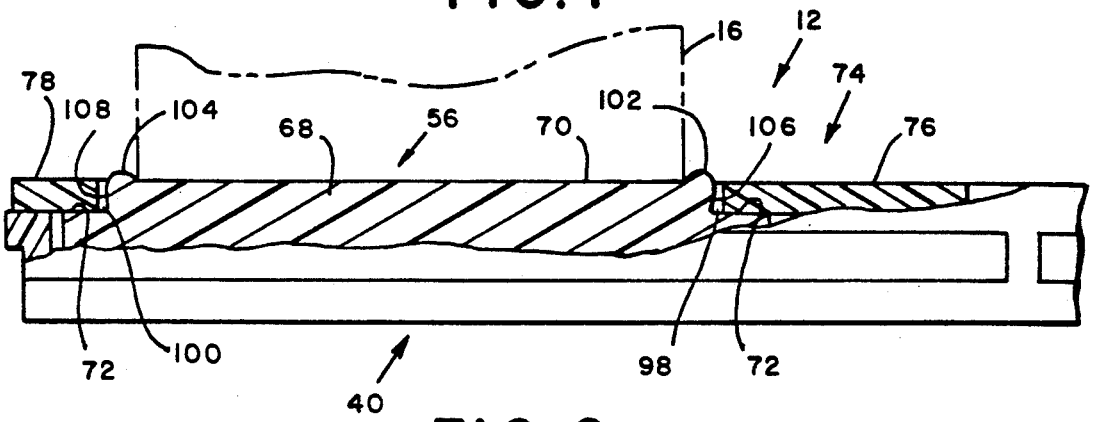
FIG. 6 is a view similar to FIG. 5 showing the configuration of the ink pad at the instant of deceleration in a forward direction of movement or acceleration in a rearward direction of movement.

The foregoing problems have been effectively solved by the present invention now to be described. FIGS. 5, 6 and 7 show the tray 40, ink pad 56 and cover member 74 assembly including the present invention in three different stages of a cycle of operation. In FIG. 5, the parts are shown in the position they assume when the inking device 12 is stationary. It will be seen that the front and rear edges 90 and 92 of the raised portion 68 are substantially vertical and are spaced slightly inwardly of the corresponding inner edges 94 and 96 of front and rear walls 76 and 78 of the cover member and are parallel thereto, thereby defining relatively small channels or spaces 98 and 100 between these edges, these channels being substantially rectangular in cross section and in the order of 0.030 to 0.050 inches in width.

FIG. 6 shows the configuration of the ink pad when it is pressed against the underside of the printing die 16, and corresponds to the same configuration as shown in FIG. 4A. At the instant that the ink pad contacts the underside of the printing die 16, the edge portions of the ink pad are swelled slightly in a configuration which is bulged upwardly with respect to the surface of the printing die, as indicated by the numerals 102 and 104, and are also bulged outwardly, as indicated by the reference numeral 106 and 108, into the spaces or channels 98 and 100 formed between the outer edges 90 and 92 of the ink pad and the adjacent inner edges 94 and 96 of the cover walls 76 and 78 respectively. As a result, any ink which is squeezed out of the ink pad by the compression of the ink pad against the underside of the printing die is momentarily collected in the channels 98 and 100. Since ink is not squeezed out onto the surface of the walls 76 and 78 of the cover 74, the ink pad can commence reabsorbing this ink even while it is still in contact with the printing die, and can further reabsorb the ink after it is moved out of contact with the printing die. Regardless of whether all of the ink in the channels 98 and 100 is reabsorbed when the ink pad reaches its bottom position, none of this ink is deposited on the surface of the cover member walls 76 and 78. This, or course, achieves the critical objective of the invention.

FIG. 7 shows the configuration of the ink pad at the instant of deceleration when the inking device is moving forwardly or at the instant of acceleration if the inking device is moving rearwardly, which is the same configuration as shown in FIG. 4B. It will be noted that the upward bulge 104 is distorted in a forward direction while the ink pad is returning to its normal configuration, but because of the space 100, the bulge 104 does not overlie the upper surface of the wall 78 and therefore could not push any ink across the surface of the wall. It should now be apparent that the same thing occurs at the opposite channel 98 when the inking device moves in the opposite direction and the deceleration force causes the edge portion 102 to overlie the space 98.

Figure 8:
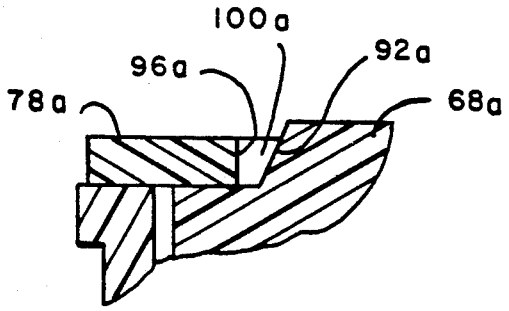
FIG. 8 is a fragmentary view similar to FIG. 5 showing an alternative form of the invention in which the edge of the ink pad is tapered.
Figure 9:
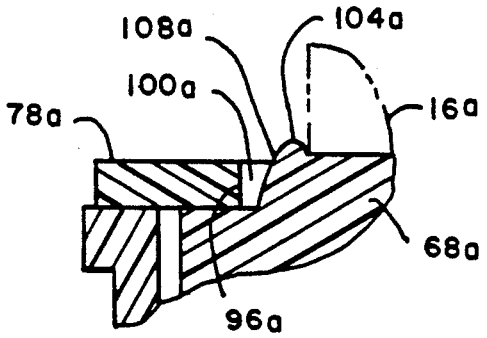
FIG. 9 is a fragmentary view similar to FIG. 6 showing the configuration of this embodiment of the in pad when under compression by the printing die.
Figure 10:
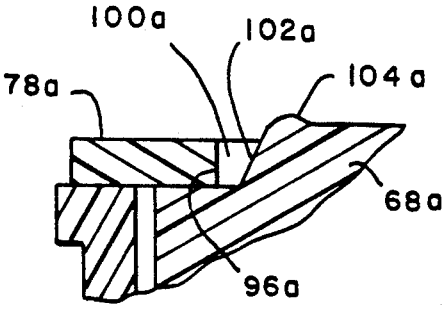
FIG. 10 is a fragmentary view similar to FIG. 7 showing the configuration of the ink pad of this embodiment at the instant of acceleration toward the home position of the inking device.

FIGS. 8, 9 and 10 show another embodiment of the invention which is similar to that previously disclosed except that the side edge **92*a* of the raised central portion 68*a* is angled upwardly away from the inner wall 96*a* of the cover member wall 78*a* so that the channel 100*a* diverges toward the upper open end thereof. This leaves a slightly wider space or channel 100*a* in which ink can collect that squeezed out by compression of the printing die. As seen in FIG. 9, the printing die 16*a* still causes an upwardly extending bulge 104*a* and an outwardly extending bulge 108*a*, with the same effect as that described above for FIG. 6. And, as seen in FIG. 10, at the instant of acceleration of the inking device toward the home position, the bulge 104*a* is flatter and less pronounced than the bulge 104 and the bulge 102*a* virtually disappears back into the slanted configuration of the wall 92*b*. Thus, this configuration provides slightly more assurance that no ink will be deposited on the surface of the cover member wall 78*a*** than is the case with the previous embodiment. A slight disadvantage of this embodiment is that it is more difficult to shape the ink pad in this configuration than it is in the previous configuration.

Figure 11:
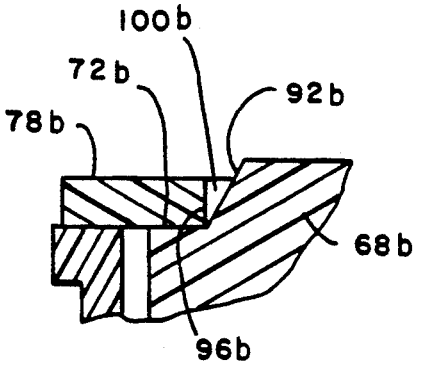
FIG. 11 is a fragmentary view similar to FIG. 8 showing still another embodiment of the invention.
Figure 12:
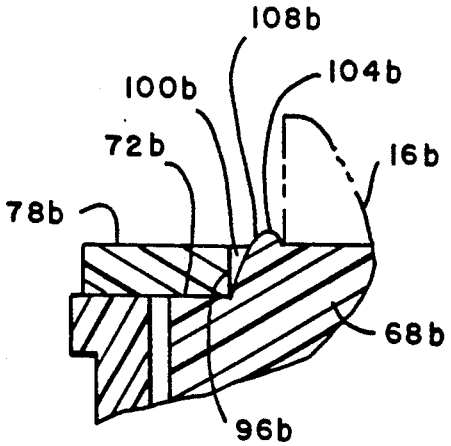
FIG. 12 is a fragmentary view similar to FIG. 9 of the embodiment of the invention shown in FIG. 10.
Figure 13:
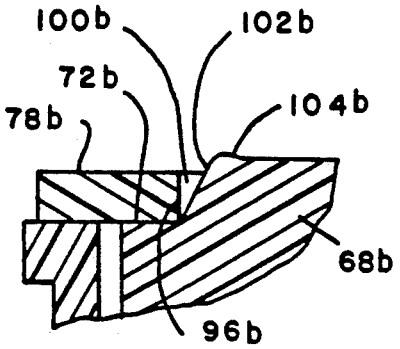
FIG. 13 is a fragmentary view similar to FIG. 10 of this embodiment of the invention.

FIGS. 11, 12 and 13 are identical to FIGS. 8, 9 and 10 except that they show another embodiment of the invention in which the slanted walls **92*b* of the raised central portion 68*b* of the ink pad commence at the bottom of the wall 96*b*, so that the channel 100*b* diverges toward the upper open end thereof but converges to a point at the lower end thereof. The effect of this configuration is substantially the same as that described above with respect to FIGS. 9 and 10 and is illustrated in FIGS. 12 and 13 with corresponding reference numerals ending in "b". Although the channel 100***b* of this embodiment will be slightly smaller than it is with either of the previous embodiments, the advantage of this embodiment is that the cover member wall 78*b* covers the entire upper surface of the flange portion 72*b* of the ink pad, thereby further ensuring that the flange portion of the ink pad cannot inadvertently slide out from under the cover member wall 78*b*, which would dislodge the ink pad.

It must be emphasized again, to fully appreciate the significance of the invention, that the amount of ink which is squeezed out onto the upper surfaces of the cover in the absence of the present invention is very minute, virtually immeasurable. It must be understood, however, that the type of mailing machine in which the inking device is found must not only operate at a high rate of speed, it must do so for a considerable length of time without interruption either from breakdown or from the need for routine service, particularly from the need for cleaning. This translates into many tens of thousands of cycles of operation without the need for cleaning, a condition which occurs after only a few thousand cycles of operation without the present invention. At that rate, it would virtually require the constant attention of a trained service person to maintain operation of the machine in an acceptable manner, which is commercially unacceptable. Also, as previously mentioned, it is critical to the operation of this type of mailing machine that it provide a clean, neat print of the postage indicia on every envelope from the first to the last, which means that the ink must be applied to the printing die in a uniform layer, and ink must not be deposited on any of the parts surrounding the ink pad. Without the present invention, this simply does not occur beyond the several thousand cycles of operation mentioned above.

What is claimed is:

1. An improved ink tray having interior side walls, an ink pad having an underside and a top portion, said ink pad supported in said ink tray above an ink tray well which extends through the underside of the ink pad, said ink tray includes (i) a plurality of channel ribs formed in said well having their respective ends spaced apart from said ink tray interior walls, (ii) a cover member fixably mounted to said ink tray and having an opening aligned above said ink well to allow said top portion of said ink pad to be fitted within said opening, and (iii) inlet means for supplying ink to said ink transfer chamber and outlet means for removing excess ink from said transfer chamber, said improvement comprising, said ink pad having a main body portion having peripheral dimensions such that said main body portion fits within said peripheral walls of said tray and covers at least a major portion of the area of said bottom wall, and a raised central portion having an upper surface adapted to contact and apply ink to the printing die of the postage meter, said raised central portion having peripheral dimensions less than the peripheral dimensions of said main body portion thereby defining a peripheral flange extending around said raised central portion, said cover member being generally flat and rectangular for securing said ink pad in said tray, said cover member having peripheral walls adapted to overlie said peripheral flange of said ink pad, said peripheral walls defining an aperture through which said raised central portion of said ink pad projects to expose said upper surface of said central portion, and at least two opposing inner edges of said cover member being spaced farther apart than the corresponding outer edges of said raised central portion of said ink pad thereby defining a small channel disposed between said inner edges of said cover member and said outer edges of said raised central portion of said ink pad, whereby ink which oozes into the distorted edge portions of said ink pad when the latter is distorted upon contact of said ink pad with the printing die of the postage meter is collected in said channel and is reabsorbed by said ink pad.

2. An inking device as set forth in claim 1 wherein said outer edges of said raised central portion of said ink pad are substantially vertical and parallel to said inner edges of said cover member whereby said channel is substantially rectangular in cross section.

3. An inking device as set forth in claim 1 wherein said outer edges of said raised central portion of said ink pad are angled upwardly away from said inner edges of said cover member whereby said channel diverges toward the upper open end thereof.

4. An inking device as set forth in claim 1 wherein said outer edges of said raised central portion of said ink pad are angled upwardly away from said inner edges of said cover member but commence at the lower end of said inner edges of said cover member whereby said channel diverges toward the upper open end thereof but converges to a point at the lower end thereof.

* * * * *